United States Patent [19]

Fleischhauer et al.

[11] Patent Number: 4,795,411

[45] Date of Patent: Jan. 3, 1989

[54] APPARATUS FOR FORMING ANNULAR GROOVES OR SLITS IN ROD-SHAPED ARTICLES

[75] Inventors: Grier S. Fleischhauer, Midlothian; Ronald D. Honaker, Powhatan, both of Va.

[73] Assignee: Philip Morris Incorporated, New York, N.Y.

[21] Appl. No.: 585,167

[22] Filed: Mar. 1, 1984

[51] Int. Cl.[4] ..... A24C 5/50; B23B 3/04; B26D 3/06

[52] U.S. Cl. ..... 493/43; 131/94

[58] Field of Search ..... 131/94, 95; 425/385, 425/301, 290, 291; 493/43

[56] References Cited

U.S. PATENT DOCUMENTS 3,648,711 3/1972 Berger et al. .
4,149,546 4/1979 Luke et al. .
4,219,030 8/1980 Hall .
4,232,574 11/1980 Hall .
4,324,540 4/1982 Sexstone et al. .
4,351,792 9/1982 Sexstone et al. .
4,369,796 1/1983 Hall .
4,385,536 5/1983 Hall .
4,492,238 1/1985 Wheless .

FOREIGN PATENT DOCUMENTS 2078089 1/1982 United Kingdom .

*Primary Examiner*—V. Millin
*Attorney, Agent, or Firm*—Jeffrey H. Ingerman

[57] ABSTRACT

An apparatus is disclosed for forming annular grooves or slits in rod-shaped articles such as cigarette filter plugs. The apparatus comprises a first endless belt or similar device and, spaced therefrom, a second element defining with the belt a channel of predetermined width. Preferably, the channel size can be adjusted by moving the belt, the second element or both toward or away from each other. The belt is driven to enable it, in cooperation with the second element, to transport a rod-shaped article along the channel. A forming device, preferably a rotating disk knife, has a portion disposed in the channel and cuts any article moved therealong. The second element is preferably contoured to be spaced a constant distance from the profile of the forming device, to insure that the groove formed in the article is concentric with the longitudinal axis of the article.

11 Claims, 1 Drawing Sheet

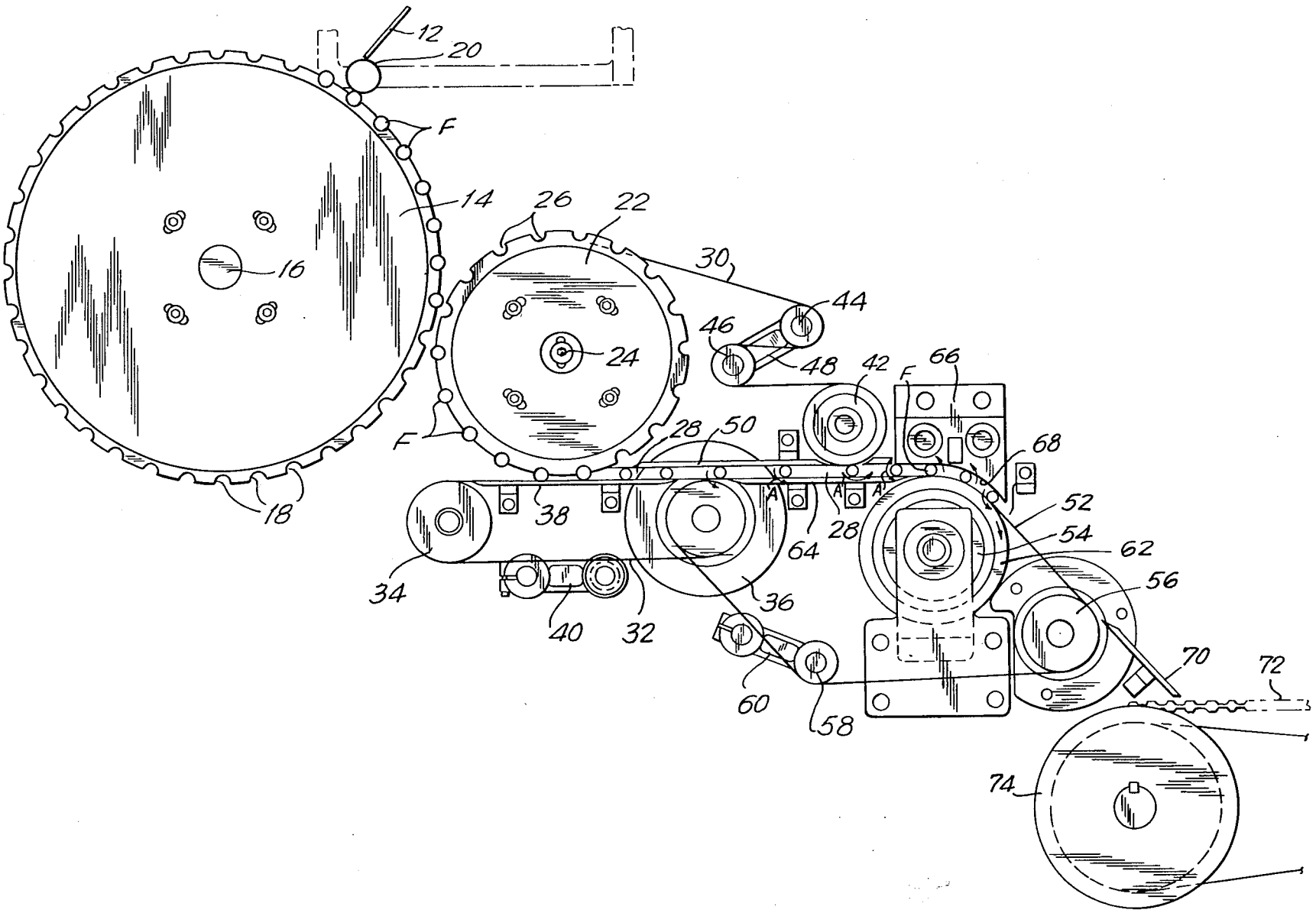
12
20
F
14
16
18
22
24
26
30
F
28
50
46
44
48
42
F
66
68
52
54
62
56
70
72
74
28
64
36
58
60
32
40
38
34

APPARATUS FOR FORMING ANNULAR GROOVES OR SLITS IN ROD-SHAPED ARTICLES

BACKGROUND OF THE INVENTION

The present invention pertains generally to apparatus for forming annular slits or grooves in rod-shaped articles such as cigarette filter plugs, and pertains more specifically to such apparatus of a type adjustable to control the depth of the slit or groove and to accommodate rod-shaped articles of different diameters.

Annular grooves are conventionally provided in filter plugs and similar objects for various purposes. For example, annular grooves in a smoke-impermeable filter plug for admitting air into the filter interior to dilute the smoke stream are known. Certain gas-phase components of cigarette smoke are also known to be adsorbable on properly treated walls of annular or other grooves formed in the outer surface of a filter plug. A smoke-impermeable, generally annular groove provided in the filter plug can also be used to produced a venturi flow of the smoke stream toward the smoker's mouth.

Various methods for producing filter plugs with such grooves are known. Commonly, the groove is cut in a filter plug by means of a rotating knife of one kind or another, frequently a rotating disc knife. The knife can be heated if it is desired to heat-seal the groove surface. If the groove is to be relatively large and need not have rectilinear sides, grooves can be formed during extrusion of the filter plugs by means of periodic constriction of the extrusion die, as disclosed in U.S. Pat. No. 3,648,711, issued Mar. 14, 1972, to Berger et al.

Most frequently, when the groove is formed by cutting, the filter plug is held during the cutting operation in a groove or flute on the periphery of a rotating drum, to which the filter plug is held by means of vacuum suction. If a relatively rounded groove, rather than a sharply defined slit, is to be provided, a heated forming element can be used instead of a knife, as for example in U.S. Pat. No. 4,149,546, issued Apr. 17, 1979, to Luke et al.

Various other methods of rolling the filter plug between two elements one of which bears the formers or other device used to produce the desired groove or slit, are known. The former may be mounted on a generally annular or cylindrical guide adjacent to the surface of a rotating drum bearing the filter plug, the latter being free to rotate while being held against the drum, as in the '546 patent cited above. In U.S. Pat. No. 4,351,792, issued Sept. 28, 1982, to Sexstone et al., and U.S. Pat. No. 4,324,540, also to Sexstone et al., the filter plugs are fed from a hopper to a peripherally fluted drum, which carries the filter plugs to the top of a vertical gap defined between an endless belt and a column of stationary formers. The belt is driven to roll the filter plugs downward along the gap over the formers, which impart the desired shape to them.

Other methods of producing such filter plugs are known, such as spin-molding, disclosed in U. K. patent application No. 2 078 089.

It would be desirable to have an apparatus for providing annular slits or grooves in rod-shaped articles, such that the apparatus could be adjusted to accommodate articles of different sizes and to make the speed of movement of the article through the machine controllable independent of the rate of rotation of the article, unlike the rolling-type devices described above.

It is therefore the principal object of the invention to provide a simple, reliable apparatus capable of forming an annular groove or slit in a rod-shaped article such as a cigarette filter plug.

Another object of the invention is to provide such an apparatus in which the feed rate of the machine can be controlled independently of the rolling speed of the articles therein.

Another object of the invention is to provide such an apparatus capable of accommodating rod-shaped articles of different diameters.

Still another object of the invention is to provide such an apparatus adapted for forming such a slit of substantially uniform depth.

SUMMARY OF THE INVENTION

The apparatus of the invention comprises a first endless belt or similar device and, spaced apart therefrom, a second element defining, with the belt, a channel of a predetermined width. The size of the channel can preferably be adjusted by moving the belt, the second element or both toward or away from each other, to accommodate articles of different sizes. The apparatus also includes a mechanism for driving the belt to enable it, in cooperation with the second element, to transport a rod-shaped article gripped between them from one end of the channel to the other.

The apparatus of the invention further comprises a forming device, which is most preferably a rotating disc knife, having a portion disposed in the channel to cut any article along the channel moved from one end to the other. A rod-shaped article such as a filter plug is rolled along the channel. If the rate of rotation of the article is sufficiently large compared to the linear speed of the article along the channel, the article is rotated at least once about its own axis while within range of the former. This results in the former producing a complete annular groove or slit in the article.

In an application where it is desired to make the groove or slit as perfectly concentric with the rod axis as possible, the surface of the second element, adjacent the former, is made parallel to and spaced a constant distance from the operative surface or edge of the former (hereinafter the "forming profile"), so that the depth of the cut or groove is uniform.

These and other features of the invention will be more clearly understood from a consideration of the following detailed description of one preferred embodiment of the invention, taken in conjunction with the accompanying figure.

BRIEF DESCRIPTION OF THE FIGURE

The FIGURE is an elevational view of the preferred embodiment of the apparatus of the invention.

DETAILED DESCRIPTION OF THE PREFERRED EMBODIMENT

The figure shows in elevation a first preferred embodiment of the apparatus of the invention.

The embodiment shown includes a conventional hopper 12 in which cigarette filter rods or other rod-shaped articles are received with their longitudinal axes horizontal and parallel. The bottom of the hopper 12 is located immediately above a drum 14 mounted for rotation about a horizontal axis 16. The periphery of drum 14 is provided with flutes 18 equally spaced about its circumference and oriented to receive filter plugs F from hopper 12. A refuser roller 20 is located at one end of the bottom of the hopper 12 and rotates in the same sense (clockwise in the device shown) as does drum 14 to prevent the accidental escape of filter rods from hopper 12, in a known manner.

Adjacent to drum 14 is a transfer drum 22 mounted for rotation about an axis 24 parallel to axis 16. The transfer drum 22 also has peripheral flutes 26 for receiving filter plugs from drum 14. The two drums 14, 22 are located and are operated in a known manner such that filter plugs F are passed from drum 14 to drum 22.

Leading away from the bottom of the transfer drum 22 is a preferably horizontal passageway or channel 28 defined between upper and lower belts 30, 32, for carrying the filter plugs away from the transfer drum 22. The lower belt 32 is mounted for rotation on two drums 34, 36 disposed below and to each side of the transfer drum 22. A plate 38 is disposed just below the upper trace of the lower belt 32 to aid in supporting the filter plugs F as they are released by the transfer drum 22. A tensioning device 40 is disposed below the lower belt 32 to control the belt tension in a known manner.

The upperside of the channel 28 is defined in the embodiment shown by belt 30, which is carried by transfer drum 22 and an additional drum 42 downstream of the transfer drum 22 and of the drums 34, 36 supporting the lower belt 32. The upper belt 30, which is received in a groove or a set of grooves formed in the circumference of the transfer drum 22, is also wrapped around two pulleys 44, 46 of a second conventional tensioning device 48, as shown. The upper belt 30 is tensioned by tensioning device 48 in a known manner. A guide plate 50 is disposed just above the lower trace of the upper belt 30 to cooperate with the lower guide plate 38 in controlling the movement of the filter rods F in the channel 28. (The vertical spacing between the two horizontal guide plates 38, 50 can, if desired, be made adjustable by suitable conventional means.) The actual movement of filter rods F along the channel 28, however, is caused by the movement of the belts 30, 32. The belts 30, 32 are driven in opposite senses at such a speed as to cause the filter rods F released by the transfer drum 22 to move horizontally away from the transfer drum 22 without rotation.

A third belt conveyor 52, whose upper trace is coplanar with that of the first lower belt 32, is disposed downstream of the latter and beneath the downstream portion of the upper belt 30. The third belt conveyor 52 is mounted on drums 36, 54, 56 and also passes around one pulley 58 of a tensioning device 60 and follows a path which is approximately a parallelogram, with the upper side of the parallelogram being horizontal.

The upper downstream drum 54 carrying the third belt 52 is an idler drum on which a disc knife 62 is concentrically mounted and driven for rotation about the axis of drum 54. An additional guide plate 64 is disposed between the two upper drums 36, 54 supporting the third belt conveyor 52 and cooperates with the upper guide plate 50 to control the filter rods F, especially as the latter pass the downstream limit of the upper belt 30.

Immediately above the idler drum 54 is a rolling block 66, mounted on the machine either fixably or in such a manner that the spacing of the rolling block 66 from drum 54 can be adjusted. The undersurface 68 of the rolling block 66 is curved to parallel the third belt conveyor 52 as the latter passes over the idler drum 54 from the upper, horizontal trace of the conveyor 52 toward drum 56.

The upper belt 30 and the third belt 52 are driven so that their opposing traces move in the same direction but at different speeds. As a result, a filter rod F between them rotates about its longitudinal axis, preferably in the direction indicated by arrows A in the figure. As the filter plug F moves downstream from the upper belt 30, it is rolled by the third belt 52 against the upper guide plate 50. The third belt 52 continues rolling the filter plug F, along the lower surface 68 of the rolling block 66.

The slitter knife 62 borne on the idler drum 54 extends somewhat above the third belt 52 and into the channel 28, and the surface 68 of the rolling block 66 is a uniform distance from the knife edge. (If a former other than a knife is used, the rolling block surface will be parallel to the contour of the operative edge, or profile, of the former.) As the filter plugs F are rolled along the rolling block surface 68, they are cut by the knife 62 to form an annular groove. Because the filter plugs F are moved along and parallel to the periphery of the circular knife 62, rather than simply being moved in a linear path past the knife 62, the grooves are of uniform depth and are concentric with the filter rod axis.

Upon reaching the downstream end of the rolling block 66, the filter plugs F slide down the third belt 52 and a guide plate 70 at the lower end of the third belt conveyor 52 onto the upper surface of a take-away conveyor 72 supported on drums 74 (only one of which is shown), for transport to the next work station.

Because the position of the roller block 66 relative to belt 52 and the knife 62 can preferably be adjusted, the depth of the grooves produced in the filter plugs can be varied at will, and a complete severing of the filter plugs can even be achieved using the apparatus of the invention by moving the rolling block 66 close enough to drum 54. Also, control of the linear speeds of the lower belt, 52 independently of that of the upper belt 30 permits the speed of the filter plug along the channel 28 to be controlled independently of the rotational speed of the filter plug F.

Although the present invention has been described in detail with respect to the preferred embodiment thereof, many variations and modifications will now be apparent to those skilled in the art. Accordingly, the present invention is to be limited, not by the details of the illustrated embodiment, but only by the terms of the appended claims.

What is claimed is:

1. An apparatus for forming an annular groove or slit in a rod-shaped article such as a cigarette filter plug, said apparatus comprising:

first belt means;

means spaced apart from said first belt means and defining therewith a channel of substantially uniform width for transporting a rod-shaped article, said channel having a center-line defined by the path followed by the longitudinal axis of a rod-shaped article with a diameter equal to the width of said channel rolling along said channel;

means for driving said first belt means for transporting a rod-shaped article in engagement with both said first belt means and said spaced-apart means along said channel and simultaneously rotating the article about the longitudinal axis of the article; and former means at least a portion of which is disposed in said channel, for forming a groove or slit in an article being transported along said channel by said first belt means and said spaced-apart means.

2. The apparatus of claim 1, wherein said portion of said former means has a forming profile for forming a slit or groove in an article, and wherein said spaced-apart means has a surface for contacting an article in said channel and for cooperating with said first belt means to roll an article along said channel past said forming profile, said surface being spaced from and parallel to said forming profile.

3. The apparatus of claim 2, wherein said former means comprises a rotating disc knife having a cutting edge, said cutting edge being said forming profile, and wherein said surface is arcuate and is spaced a constant distance from said cutting edge as measured perpendicular to said center-line of said channel.

4. The apparatus of claim 3, wherein said spaced-apart means comprises second belt means defining, with said first belt means, a first part of said channel, said arcuate surface defining, with said first belt means, a second part of said channel.

5. The apparatus of claim 2, wherein said forming profile and at least the portion of said channel in which said portion of said former means is disposed are both straight.

6. The apparatus of claim 1, comprising several former means for forming a corresponding number of grooves or slits in an article.

7. The apparatus of claim 1, further comprising means for adjusting the location of said portion of said former means in said channel.

8. An apparatus for forming an annular groove or slit i a cigarette filter plug or other rod-shaped article, said apparatus comprising:

first and second channel defining means defining between them a channel for transporting a rod-shaped article;

means for transporting a rod-shaped article in engagement with said first and second means along said channel and simultaneously rotating the article about the longitudinal axis of the article; and former means having a portion disposed in said channel for forming a groove or slit in an article being transported along said channel;

said second channel-defining means being adapted to maintain an article being transported along said channel in such an attitude relative to said former means that said former means forms an annular groove of uniform depth in the article.

9. The apparatus of claim 8, wherein said former means comprises a rotating disc knife.

10. The apparatus of claim 8, wherein said first and second channel-defining means are adapted to cause a rod-shaped article being transported along said channel to make at least one complete revolution about the longitudinal axis of the article while passing through the portion of said channel in which said portion of said former means is disposed.

11. The apparatus of claim 8, further comprising means for adjusting the location of said portion of said former means in said channel.

* * * * *

UNITED STATES PATENT AND TRADEMARK OFFICE

CERTIFICATE OF CORRECTION

PATENT NO. : 4,795,411

DATED : January 3, 1989

INVENTOR(S) : Grier S. Fleischhauer et al.

It is certified that error appears in the above-identified patent and that said Letters Patent is hereby corrected as shown below:

Claim 8, column 6, line 5, "i" should be -- in --.

Signed and Sealed this

Twenty-third Day of April, 1991

*Attest:*

HARRY F. MANBECK, JR.

*Attesting Officer*

*Commissioner of Patents and Trademarks*